US005579650A

United States Patent [19]

Cleland et al.

[11] Patent Number: 5,579,650

[45] Date of Patent: Dec. 3, 1996

[54] HEAT EXCHANGER

[76] Inventors: Robert K. Cleland, 11051 Via El Mercado, Los Alamitos, Calif. 90720; Larry Roberts, 10 Black Hawk Estates, Old Monroe, Mo. 63369

[21] Appl. No.: 419,286

[22] Filed: Apr. 10, 1995

Related U.S. Application Data

[63] Continuation-in-part of Ser. No. 349,561, Dec. 5, 1994.

[51] Int. Cl.[6] ..... B67D 5/62; F28F 13/06

[52] U.S. Cl. ..... 62/392; 62/394; 165/108

[58] Field of Search ..... 62/389, 390, 393, 62/392, 394, 430, 434; 165/108, 140

[56] References Cited

U.S. PATENT DOCUMENTS

| | | | |
|---|---|---|---|
| Re. 16,605 | 4/1927 | Ridler | 62/390 |
| 1,891,714 | 12/1932 | Jordan et al. | 62/393 |
| 2,596,195 | 5/1952 | Arbuckle | 62/394 |
| 3,090,210 | 5/1963 | Groff | 62/389 |
| 3,670,522 | 6/1972 | Bresin | 62/333 |
| 3,786,649 | 1/1974 | Kirschner | 62/201 |

FOREIGN PATENT DOCUMENTS

| | | | |
|---|---|---|---|
| 586255 | 3/1947 | United Kingdom | 62/393 |

*Primary Examiner*—William Doerrler
*Attorney, Agent, or Firm*—George A. Maxwell

[57] ABSTRACT

A heat exchanger comprising an elongate tank with top, bottom, side, front and rear walls. A plurality of longitudinally spaced partitions are positioned within the tank and define an elongate serpentine or zig-zag liquid conducting flow passage with upstream and downstream ends. An elongate serpentine or zig-zag formed fluid coolant conducting coil is positioned centrally within and extends longitudinally of the flow passage. The coil has an upstream end portion exiting the tank at the downstream end of the flow passage and a downstream end portion exiting the tank at the upstream end of the flow passage. Liquid inlet and outlet fittings connected with a valve-controlled fluid supply and dispensing means conduct liquid into and out of the flow passage. A fluid recirculating pump has a suction side connected with the downstream end of the flow passage and a discharge side connected with the upstream end of the flow passage and continuously recirculates liquid longitudinally within the flow passage and about the coil.

16 Claims, 6 Drawing Sheets

40
41
J
7
26
25
F
T
31
30
7
6
4
21
F
C
P
P
5
20
5
G
4
C
23
C/V
C/V
P
N
V
W 53
51
56
54
25
T
D
56
J
40
41
20'
52
23
50
C
21'
C 54
61

50
52
56
T
60

HEAT EXCHANGER

This application is a continuation in part of U.S. application Ser. No. 08/349,561, filed Dec. 5, 1994, and entitled, "Beverage-Dispensing Machine."

BACKGROUND OF THE INVENTION

Throughout the arts, there are many instances where it is required that liquids must be chilled and where chilling the liquids is effected by the transfer of heat between the liquids and prechilled fluid coolants. To effect such transfer of heat, the fluids and coolants are conducted through heat exchange structures including adjacent fluid and coolant-conducting means that separately handle the fluids and coolants and through which heat is transferred from the liquids to the coolants.

Typically, the liquid to be chilled is water or a beverage or other acquiesce solution. The prechilled coolant can be water, an antifreeze solution such as glycol; or, a refrigerant such as freon.

For the purpose of this disclosure, the fluid to be chilled is potable water received from a common pressurized water supply system and that is chilled for serving and/or for the making and serving of chilled beverages, such as lemonade.

The most common and widely used prior art water chillers provided to dispense chilled potable water for drinking or making and serving chilled beverages, such as lemonade, are called ice bank chillers. Those chillers consist of unsealed tanks filled with volumes of heat transfer water. Elongate stainless steel water-conducting coils, through which potable water to be chilled is conducted, are arranged within the outer perimeters of the tanks and are immersed in the heat transfer water. Elongate refrigerant expansion coils are arranged centrally in the tanks in inward spaced relationship from the water coils. The refrigerant expansion coils are parts of common refrigeration machines that are parts of the water chillers. The coolants (freon refrigerant) are conducted through the expansion coils and freeze the heat transfer water about the coils to create banks of ice in the central portions of the tanks. The banks of ice chill the remainder of the heat transfer water in the tanks, in which the water coils are immersed. The chilled heat transfer water absorbs heat from the potable water flowing through the water coils.

Ice bank chillers of the character referred to above are, from the standpoint of size, weight and power consumption, extremely inefficient. As the volumetric demand for chilled water increases, the size, weight and power consumption of ice bank chillers increase at an exponential rate.

In most instances, space that is available to accommodate ice bank chillers is costly or expensive space and is, with few exceptions, quite limited. As a result of the foregoing, there are many instances where the demands for chilled water cannot be met with ice bank chillers.

Another serious shortcoming of ice bank chillers resides in the fact that the rates of flow of potable water therethrough must be carefully monitored to assure that the volumes of warm inflowing water do not result in rapid melting away of the ice banks, since as the ice banks melt away or down, the efficiency of the chillers to chill the water is reduced at an exponential rate. Further, when the ice banks are melted down to an extent that the potable water is not suitable chilled, the chillers must be put out of service a sufficient period of time to allow the ice banks to grow to full and efficient size. Since the ice banks are created by refrigerants flowing through the expansion coils deep within the ice banks, growing of new ice at the exterior of the ice banks is an extremely slow process that often takes many hours.

In furtherance of the above, it is to be noted that when ice bank chillers are put into service, they must be let to run idle for several hours to allow effective ice banks to be built and before chilled potable water can be drawn therefrom. This is a serious shortcoming since it requires along initial "chill-down time" prior to putting the chillers to their intended use.

In addition to the above-noted ice bank chillers, the prior art provides more sophisticated, complicated and notably more costly chillers for chilling water. One such chiller consists of a tank containing a supply of potable water, a metal canister within the water in the tank and an expansion coil of a refrigeration machine within the canister. The metal canister absorbs heat from water in the tank and conducts it to the coil within the canister. The refrigerant conducted through the coil absorbs and carries away the heat.

Another common form of heat exchangers that are widely used to chill water and beverages consists of cold plates of cast aluminum within which coolant and water-conducting coils are arranged. Coolants, chilled by suitable coolant-chilling means, such as ice bank chillers, are conducted through the coolant coils in the plates to carry heat out and away from the plates. The chilled plates absorb heat from the water flowing through the water coils in the plates. The cold stored by the plates make these heat exchangers quite effective and efficient. The size of these exchangers is quite small, with respect to their capacity to chill water, and are such that they can be conveniently accommodated in spaces where other water-chilling means, such as ice bank chillers, cannot be accommodated. Cold plate chillers must be used in combination with other water chiller means that supply them with the required coolants.

To the best of our knowledge and belief, all of those prior art heat exchanger means suitable for chilling water or the like, in which a prechilled coolant is used to chill a liquid, such as water, make poor and inefficient use of the prechilled coolants and, with possible exceptions, tend to be excessively large, heavy and costly to make, operate and maintain.

OBJECTS AND FEATURES OF THE INVENTION

It is an object of the present invention to provide an improved heat exchanger to effect chilling of water or other liquid by means of a prechilled fluid coolant and in which the flow of liquid and coolant is managed and controlled to attain a more effective and efficient exchange of heat therebetween than is attained by many of those prior art heat exchangers that are provided for the same or similar uses to which our new heat exchanger can be advantageously put to.

It is an object and feature of the invention to provide a heat exchanger of the general character referred to above wherein a supply of water or equivalent liquid to be chilled is continuously recirculated through an elongate flow passage, from an upstream to a downstream end thereof; wherein a chilled liquid coolant, such as water, glycol or freon, is conducted into the inlet end of a coolant tube or coil entering the downstream end of the flow passage and continues longitudinally therethrough to the upstream end thereof so that the flow of coolant is countered to the flow of liquid; and, wherein means are provided to intermittenly draw off chilled water from within the flow passage as desired and to simultaneously replace water drawn from the flow passage to maintain the flow passage filled with water at all times.

It is another object and a feature of the invention to provide a new and improved heat exchanger of the general character referred to above wherein the coolant-conducting tube or coil has elongate upstream and downstream portions with free ends that exit the tank at one end of the flow passage and each of which portion extends longitudinally of the flow passage through which the water to be chilled circulates; so that the surface area of the coolant tube or coil that is contacted by water is substantially doubled and so that the coolant is caused to flow both upstream and downstream through the water-conducting flow passage for most effective and efficient transfer of heat within the heat exchanger.

It is an object and a feature of the invention to provide a heat exchanger of the general character referred to above wherein the flow passage is an elongate serpentine or zig-zag flow passage defined within a sealed tank by a plurality of laterally spaced thin sheet metal partitions positioned within the tank and in which the coolant-conducting tube is an elongate serpentine or zig-zag formed liquid-conducting coil.

Yet another object and a feature of the invention is to provide a heat exchanger of the general character referred to above wherein the thin sheet metal partitions define adjacent elongate parallel leg portions of the flow passage and present large surface areas for effective and efficient transfer of heat between water flowing through adjacent leg portions of the flow passage.

Still another object and feature of the invention is to provide a heat exchanger of the general character referred to above wherein the volume of water circulating through the flow passage is sufficiently greater than the maximum anticipated volume of chilled water drawn from within the flow passage and the volume and flow rate of coolant conducted through the coolant coil are such that water, chilled as desired, can be drawn substantially continuously with little appreciable elevation in temperature of the water drawn from the heat exchanger.

It is an object and a feature of this invention to provide a heat exchanger of the general character referred to above the size and weight of which is a small fraction of the size and weight of ice bank chillers and other prior art heat exchangers that are provided to deliver comparable volumes of similarly chilled water.

Another object and feature of the invention is to provide a heat exchanger of the general character referred to including a normally closed water-dispensing valve means that is selectively operable to open and effect the drawing of chilled water from within the flow passage and a water inlet means with check valve means connected with and between a pressurized water supply and the flow passage so that as chilled water is drawn from within the flow passage replacement water is conducted into the flow passage to maintain the flow passage filled with water at all times.

A further object and a feature of the invention is to provide a heat exchanger of the general character referred to above wherein the coolant is glycol or refrigerant, the temperature of which is below the freezing temperature of the liquid or water, to chill the water in the flow passage near freezing; and, wherein the flow of coolant through the coil is controlled by a coolant supply means that is controlled by a thermally actuated switch that is responsive to the temperature of the water in the flow passage.

Yet another object and feature of the invention is to provide a heat exchanger of the general character referred to above that further includes a normally closed pressure-responsive switch connected in the power supply to the coolant control valve means and that is responsive to the pressure within the tank so that if the pressure within the tank increases as a result of the growth of excessive ice about the coolant-conducting coil, the flow of coolant is shut off while excessive ice melts and the pressure in the tank returns to normal operating pressure.

Finally, it is an object and a feature of the invention to provide a heat exchanger of the general character referred to above which is such that after first being put into operation it will dispense chilled water within a period of 20 minutes.

The foregoing and other objects and features of our invention will become apparent and will be fully understood from the following detailed description of typical preferred forms and applications of the invention throughout which description reference is made to the accompanying drawings.

DETAILED DESCRIPTION OF THE INVENTION

Figure 1:
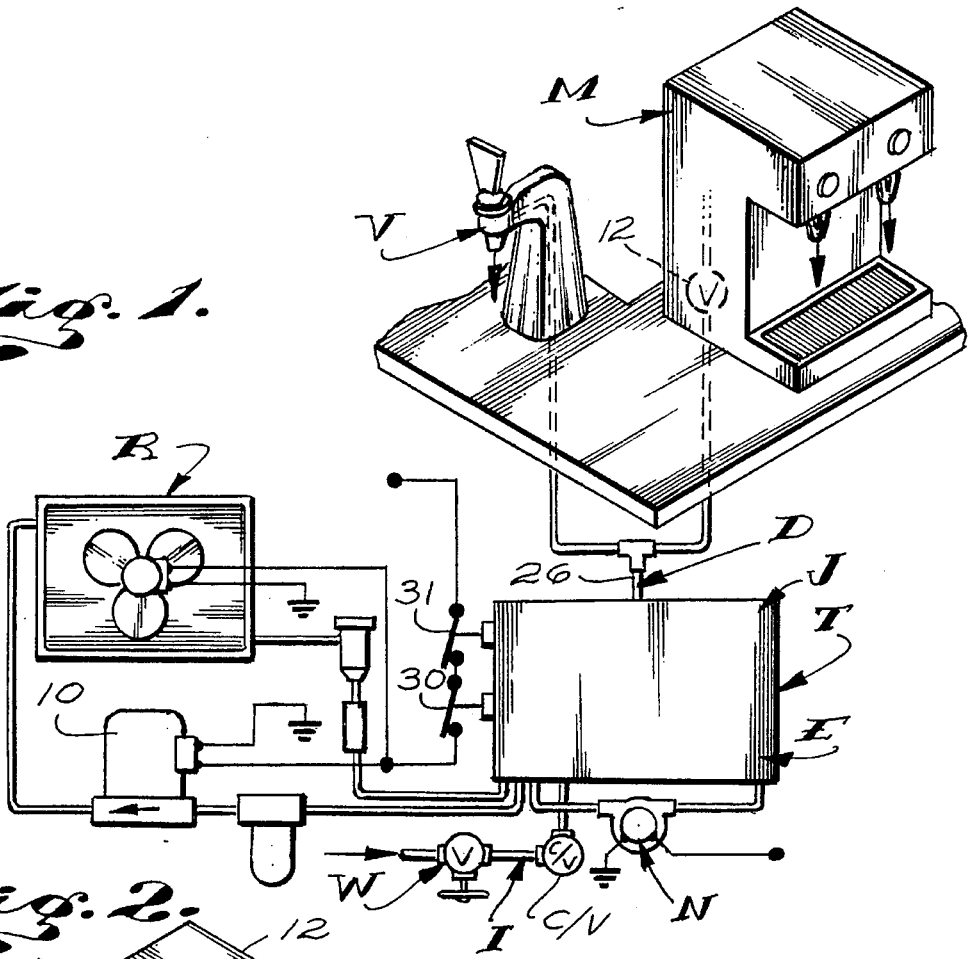
FIG. 1 is a diagrammatic view of one water-chilling system including one heat exchanger embodying the present invention.

Referring to FIG. 1 of the drawings, our new heat exchanger E is shown embodied in a water-chilling supply system and apparatus in which tepid potable water is chilled by freon refrigerant coolant conducted through a coolant-conducting tube or coil C (see FIG. 3 of the drawings) of the exchanger E by means of a compressor 10 of a conventional refrigeration machine R.

In the system illustrated, the coolant coil C of the exchanger E is utilized as the evaporator coil of the refrigeration machine R.

In the noted system, the exchanger E is connected with a hose bib or valve of a pressurized water supply W and, for the purpose of this disclosure, is shown connected with a normally closed selectively operable chilled water-dispensing valve V and with a common counter top beverage mixing and dispensing machine M that includes normally closed valve means 12.

The system shown is such that chilled water flows out of the exchanger E to and from the valve V whenever that valve is open and flows from the exchanger to the beverage machine M whenever the valve means 12 thereof is opened. In practice, other means to be supplied with chilled water can be connected with the exchanger, as desired or as circumstances require.

The refrigeration machine R can be any one of numerous commercially available or specially built refrigeration machines, the nature and character of which are well known to those skilled in the art and need not be described in detail. It will suffice to note that the compressor 10 of the machine R is an electrically powered unit and that the machine, when operating, continuously circulates refrigerant (coolant) through the coil C of the exchanger E.

Figure 2:
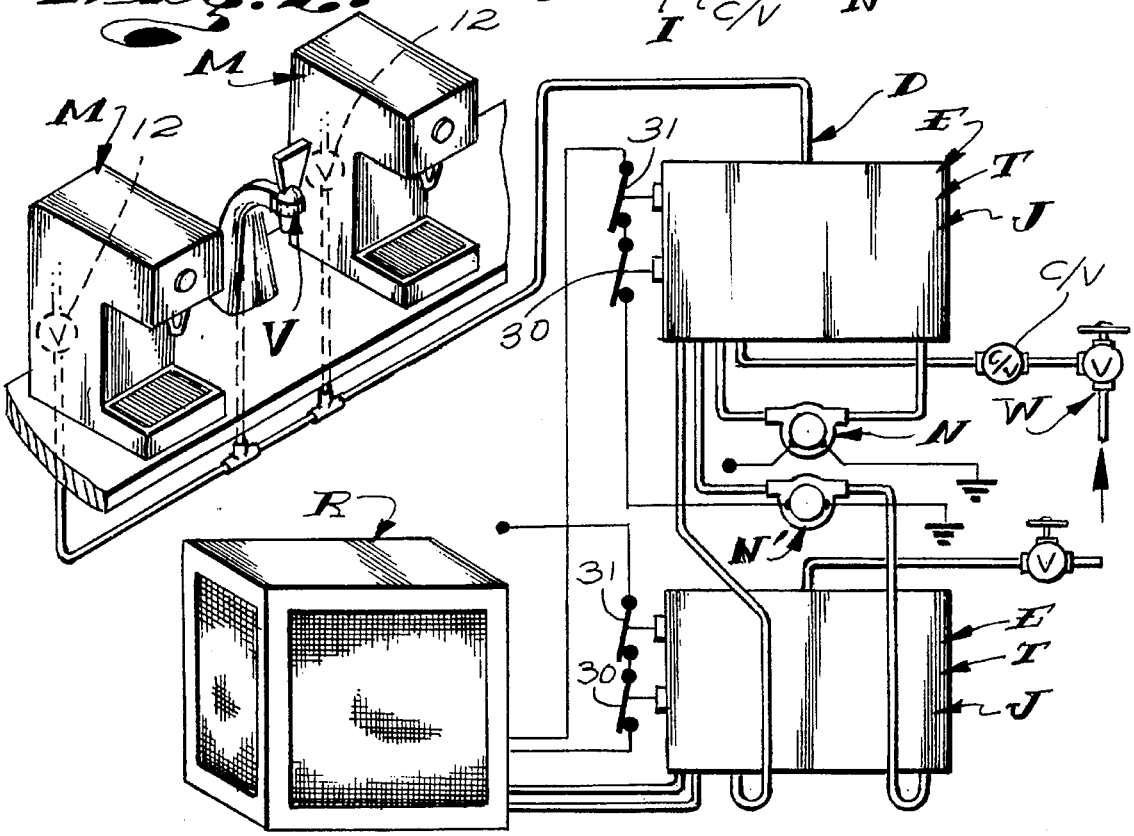
FIG. 2 is a diagrammatic view of another water-chilling system and apparatus including two heat exchangers embodying the present invention.

Referring to FIG. 2 of the drawings, we have shown a system and apparatus for supplying chilled water that includes two heat exchangers E and E'. In this system, the exchanger E' is provided to chill a suitable antifreeze coolant, such as glycol. The chilled glycol is conducted into and through the exchanger E to chill potable water or the like that is to be dispensed for drinking or for any other 9 desired use.

It is to be noted that the heat exchanger E' and its related refrigeration machine R (which is shown encased) establishes what is commonly referred to in the art as a "glycol chiller machine." It is to be further noted that the provision and use of glycol chiller machines is resorted to when coolant must be conducted and transported a substantial distance to remote heat exchanger means. Accordingly, though the heat exchangers E and E' are shown as being closely related to one another, the exchanger E can be spaced a substantial distance from the exchanger E'.

It is to be noted that when glycol or the like is used as a coolant, any glycol chilling and recirculating machine might be used to supply chilled coolant to the exchanger E in the system and apparatus now under consideration and that the provision and use of a glycol chilling machine embodying our new heat exchanger E', as illustrated, while preferred, is not necessary and that any suitable coolant supply means can be utilized.

Figure 3:
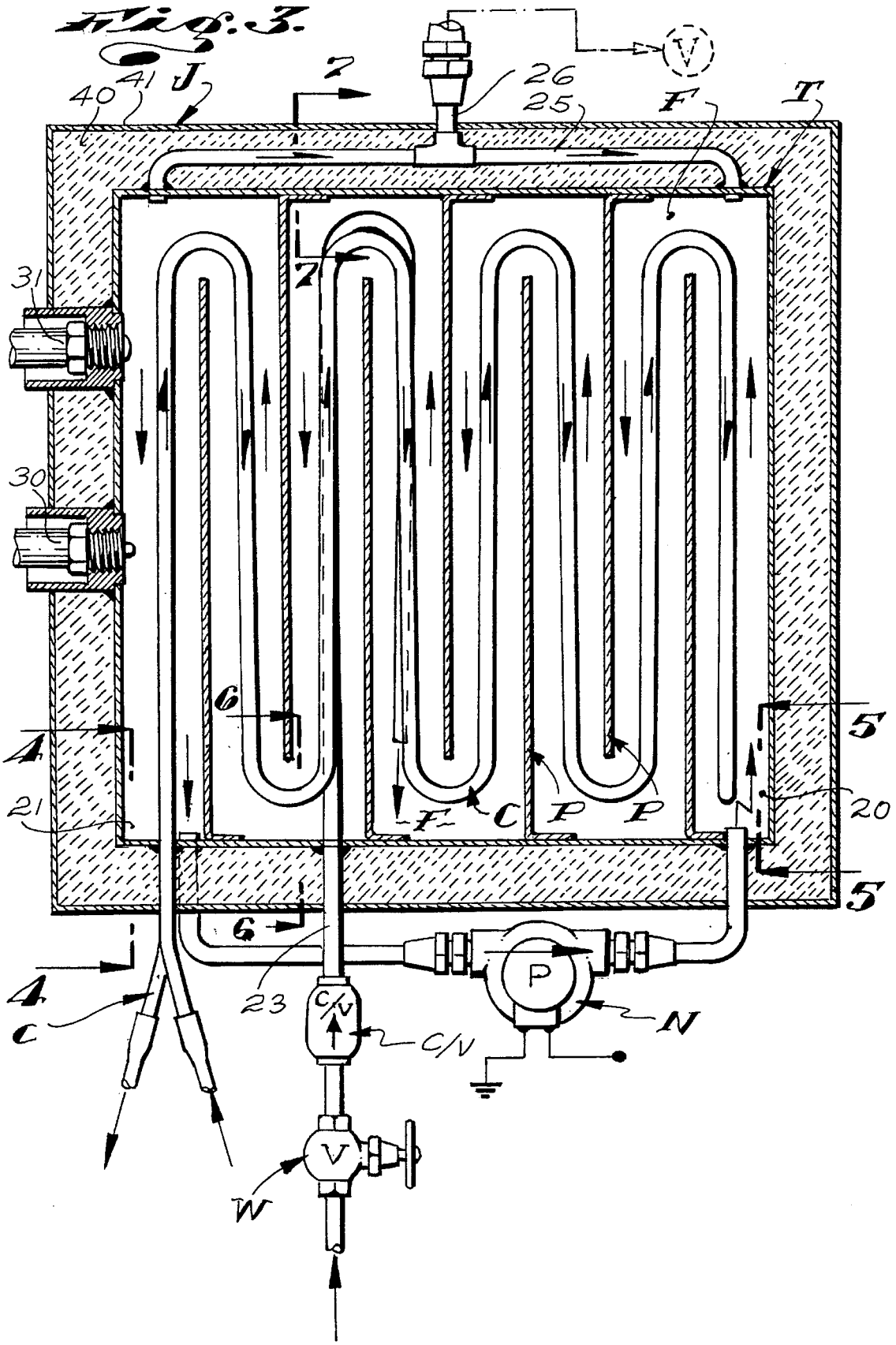
FIG. 3 is a cross-sectional view of the heat exchanger.
Figure 4:
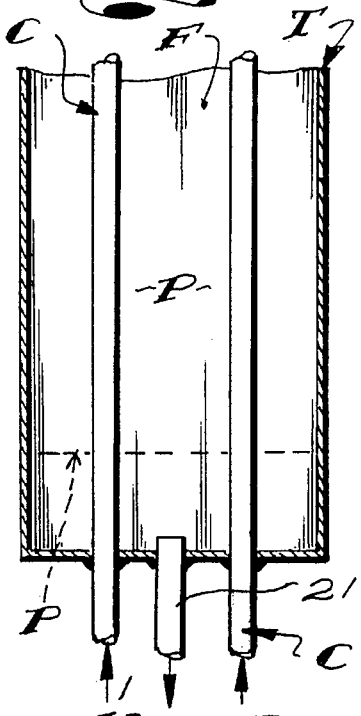
FIG. 4 is a sectional view taken substantially as indicated by Line 4—4 on FIG. 3.
Figure 5:
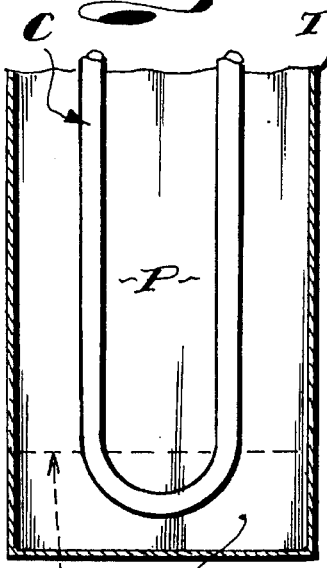
FIG. 5 is a sectional view taken substantially as indicated by Line 5—5 on FIG. 3.
Figure 6:
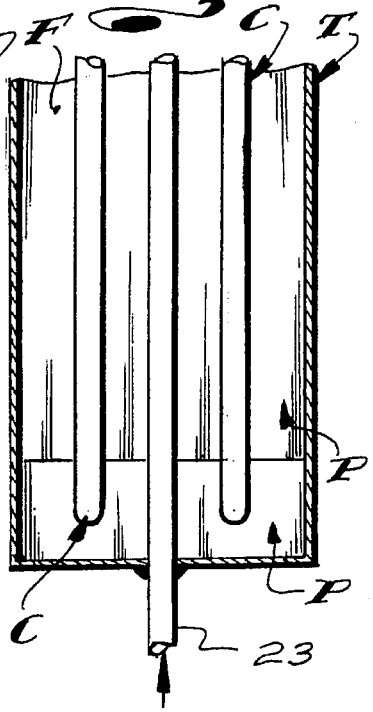
FIG. 6 is a sectional view taken substantially as indicated by Line 6—6 on FIG. 3.
Figure 7:
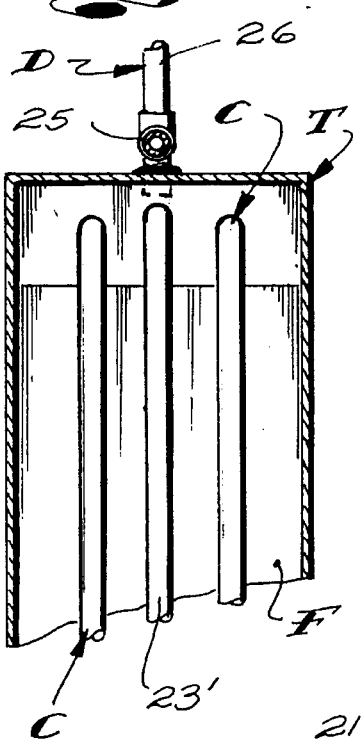
FIG. 7 is a sectional view taken substantially as indicated by Line 7—7 on FIG. 3.

Referring to FIG. 3 of the drawings, the new heat exchanger E includes a pressure sealed tank T with a plurality of partitions P within it. The partitions P define an elongate serpentine or zig-zag flow passage F with upstream and downstream ends 20 and 21 and through which the liquid to be chilled or water is continuously circulated. The tank T and partitions P can be established of stainless steel and such that potable water or the like can be conducted through the exchanger without contamination or the like.

An electric powered liquid or water recirculating pump N is provided to maintain the water within the tank recirculating and continuously flowing longitudinally through the flow passage F. The pump N has a suction side suitably connected with the downstream end 21 of the flow passage F and a discharge side suitably connected with the upstream end 20 of the flow passage F.

The exchanger E next includes a liquid or water inlet means I including a water supply line 23 entering the tank and communicating with the flow passage F and in which a check valve C/V is engaged to check the backflow of water from the tank through the line 23. The line 23 is suitably connected with the valve of the water supply means W.

In the preferred carrying out of the invention, the line 23 is extended into the flow passage F to form a prechiller tube 23' that extends through a portion of the flow passage F so that the liquid or water flowing into the tank or flow passage is suitably chilled before it is discharged (dumped) into the already chilled water flowing through the passage. This effectively prevents yet-to-be chilled water introduced into the flow passage from creating "hot spots" in the column of chilled water recirculating through the exchanger.

The exchanger E next includes chilled liquid or water outlet or dispensing means D. The means D includes a chilled liquid-conducting line 25 with a downstream end that communicates with the upstream end portion of the flow passage F and an upstream end that communicates with the downstream end portion of the flow passage F; and, a liquid dispensing line 26 connected with the line 25 and that extends from the exchanger E to connect with one or more normally closed water-dispensing valve means, such as the valve V and/or valve means 12.

It is to be noted that due to the friction-induced pressure drop between the upstream and downstream ends of the flow passage F, chilled water continuously recirculates through the line 25.

The heat exchanger E next includes the above-noted elongate serpentine or zig-zag tubular coolant-conducting tube or coil C. The coil C, like the tank T and partitions P is preferably established of stainless steel. The coil C is arranged within the tank T to extend longitudinally of and substantially centrally within the flow passage F. The coil C has upstream and downstream ends that extend from within the passage F and the tank T and that are suitably connected with the refrigeration machine R or other means provided to supply and effect circulation of coolant through the coil C.

Figure 8:
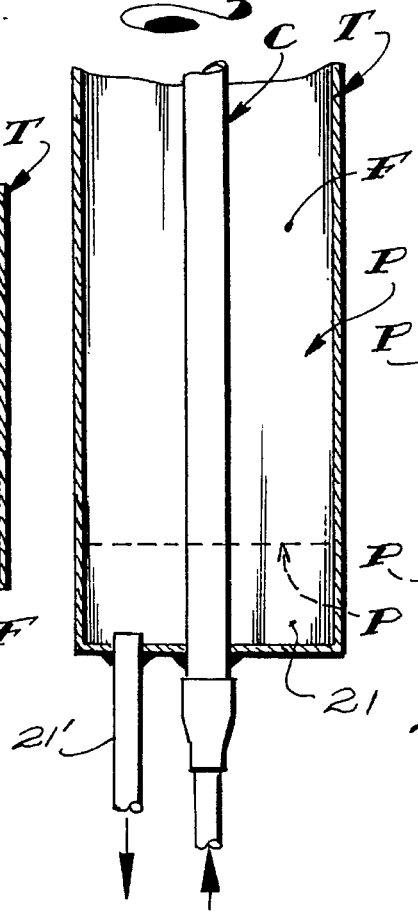
FIG. 8 and 9 are views similar to FIGS. 4 and 5 and show a modified form of the invention.
Figure 9:
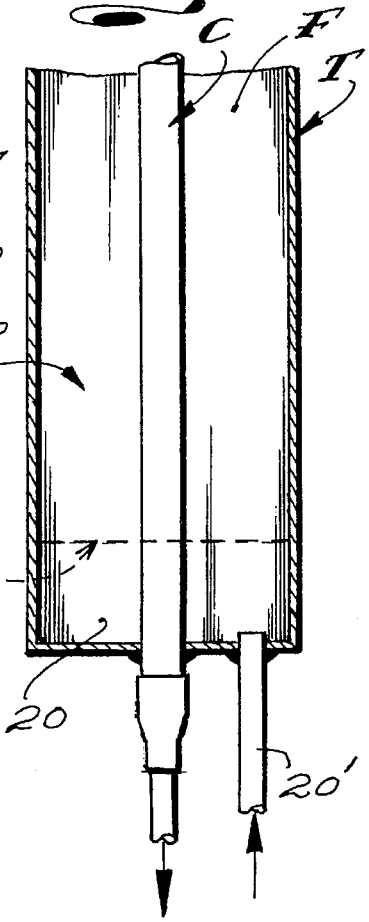

In one form and carrying out of our invention and as shown in FIGS. 8 and 9 of the drawings, the upstream end of the coil C enters the downstream end 20 of the flow passage F and the downstream end of the coil C exits the upstream end of the flow passage F so that the direction of flow of coolant through the coil is counter to the direction of flow of water through the flow passage. With this relationship of parts, the coolant chills the water flowing through the downstream end portion of the flow passage before it (the coolant) absorbs heat from the water and is warmed. The coolant continues to absorb heat from the water as it advances downstream through the coil and upstream relative to the flow of water in the flow passage. This controlled, opposite flow of coolant and water has been found to best utilize the coolant and to notably increase the effectiveness and efficiency of the heat exchanger.

In the preferred carrying out of our invention and as shown in FIGS. 3 through 7 of the drawings, the length of the coil C is substantially twice as long as the flow passage F and has upstream and downstream end portions, each of which is substantially coextensive with the flow passage. In this embodiment of the invention, the effective temperature of the coolant that is conducted through the coil, back and forth through the flow passage F, is substantially balanced and uniform from one end of the flow passage to the other. Still further, the noted doubling and turning back of the coil doubles the effective heat transfer surface area of the coil and doubles the time that it takes the coolant to advance through the coil. This relationship of parts provides for the most effective and efficient exchange of heat between the coolant and the water.

In practice, when the coolant is freon or the like, the coolant used dictates what the diameter and the length of the coil must be. If the coil C is not doubled back on itself, as noted above and shown in the drawings, the flow passage F must be as long as the coil and the overall dimensions and size of the exchanger must be of a size that is capable of accommodating the flow passage and coil. On the other hand, when the coil is doubled back upon itself, as shown, the length of the flow passage is halved and the dimensions and size of the exchanger is notably reduced.

The heat exchanger E next includes temperature and/or pressure responsive switch means 30 and 31 that are responsive to the temperature and to the pressure within the exchanger E and that control the operation of the coolant supply and/or coolant recirculating means. When the coolant supply and recirculating means includes the noted refrigeration machine R, the switches 30 and 31 are engaged in the power supply to the compressor of the refrigeration machine. When the coolant is chilled glycol or the like, the switches 30 and 31 are connected with an electric-powered coolant recirculating pump means N or with other suitable normally open electrically operated valve means (not shown).

The switches 30 and 31 operate to stop the flow of coolant through the exchanger when the temperature of the water reaches a predetermined low temperature and/or when the pressure within the exchanger increases above a predetermined safe operating pressure. The function of the pressure-actuated switch 31 is of particular significance since it enables the exchanger E to chill the water therein to very near freezing without the likelihood of the exchanger being disabled and/or damaged by the formation and growth of ice and about the coil C and within the flow passage F.

In the art of handling and working with chilled water and the like, it is well known that if and when water is let to freeze to ice, the ice will stop-up and disable the water-handling equipment. More important, the expansion of water, as it freezes, can be expected to do irreparable damage to the equipment in and about which the ice forms. As a result of the foregoing, when chilling liquids it has long been considered in the art to be good and common practice to avoid chilling the liquids to a low temperature at which the liquid might freeze. This practice effectively prevents chilling of water and the like to near freezing. As a result of the foregoing, when chilling water, the freezing temperature of which is, for example, 32° F., water is seldom chilled to temperatures below 38° F.

With our new heat exchanger E, wherein the tank T is sealed and is completely filled with water at all times, if excess ice forms about the coil C, within the flow passage F in the tank T, the growth of ice increases the pressure within the tank. The switch 31 is adjusted and set to open and to cause the flow of coolant through the exchanger to stop when the pressure in the tank increases as a result of the growth of ice about the tube or coil within the tank. Thus, unless the switch 31 is improperly set or malfunctions, the growth of excess ice in the exchanger is not let to occur.

Our exchanger E effectively dispenses water at 33° F.

Finally, the exchanger E includes a thermal-insulated jacket structure J that is shown in FIGS. 1, 2, 3 and 10 of the drawings. The jacket structure J includes a metal case 40 that occurs in spaced relationship about the tank T and a body 41 of hard noninterconnected cellular heat insulating foam that fully occupies the space between the case 40 and the tank T.

It is to be noted and understood that all of the parts of the systems including our new exchanger are thermally insulated as circumstances require and in accordance with good and common practices.

Figure 10:
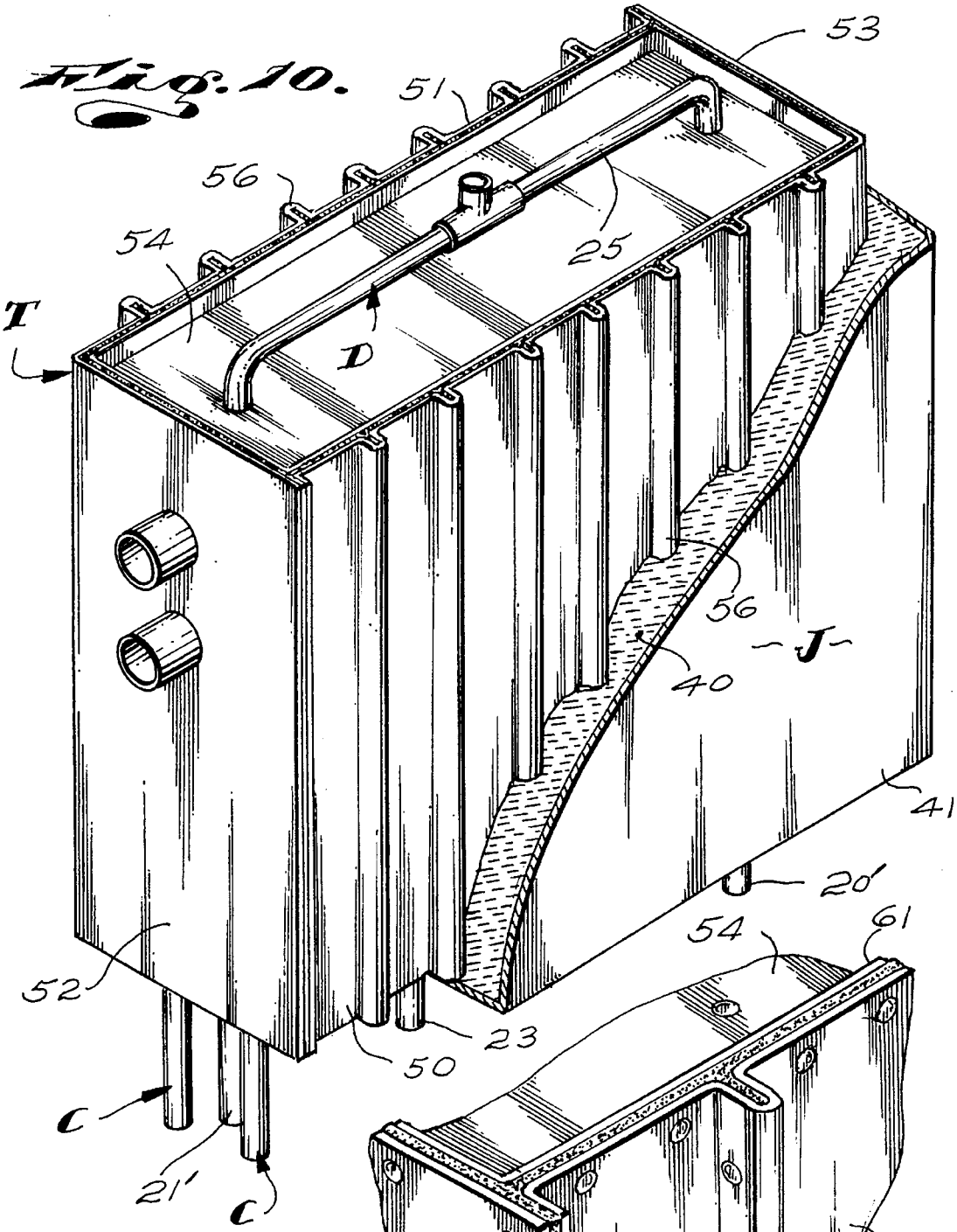
FIG. 10 is an isometric elevational view of the heat exchanger with portions broken away to better illustrate details of the construction.
Figure 11:
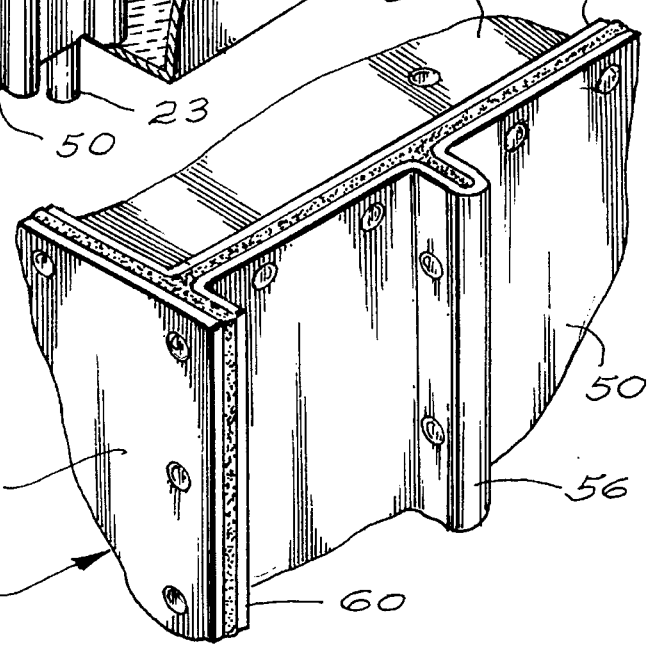
FIG. 11 is an enlarged isometric view of a portion of the structure shown in FIG. 10.
Figure 12:
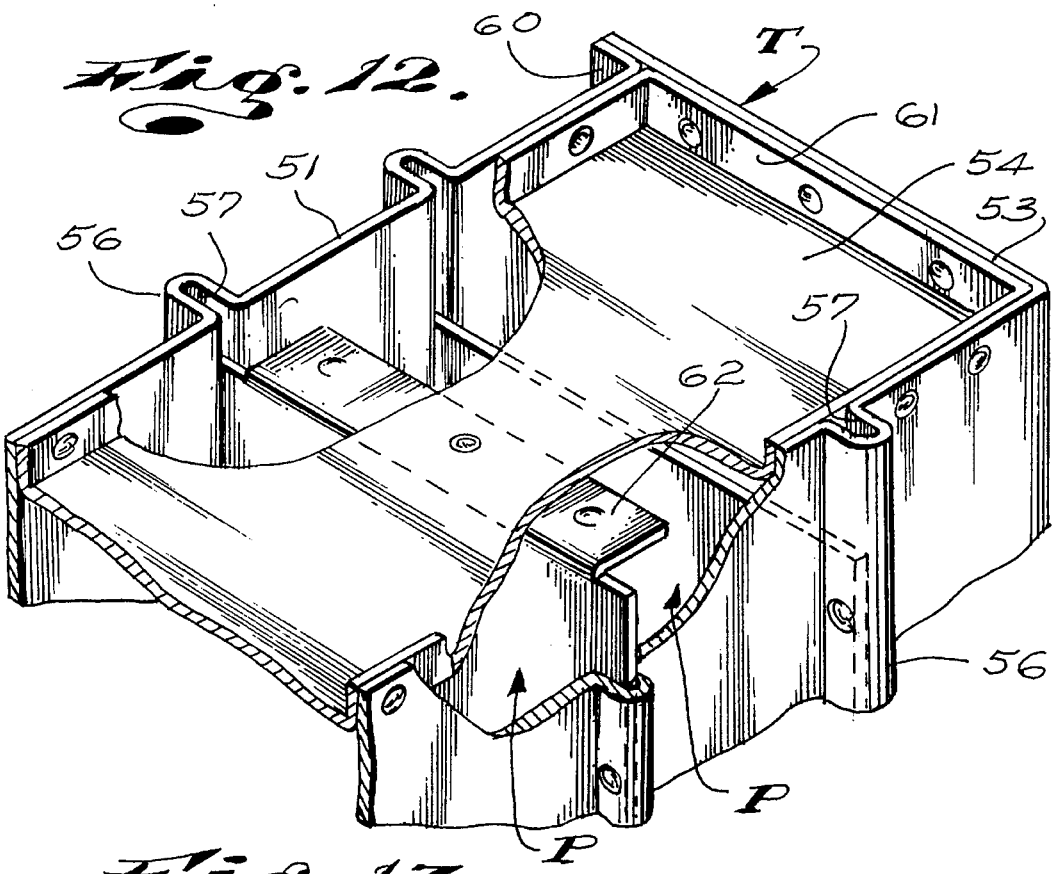
FIG. 12 is an isometric view of a portion of the structure shown in FIG. 10 with portions broken away to show details of the construction.
Figure 13:
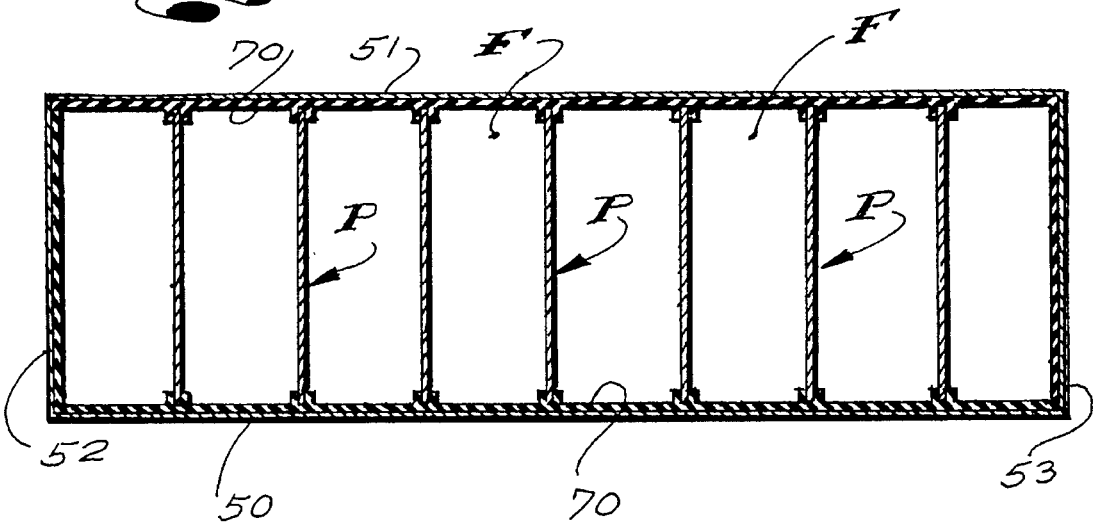
FIG. 13 is a cross-sectional view of another form of the invention.
Figure 14:
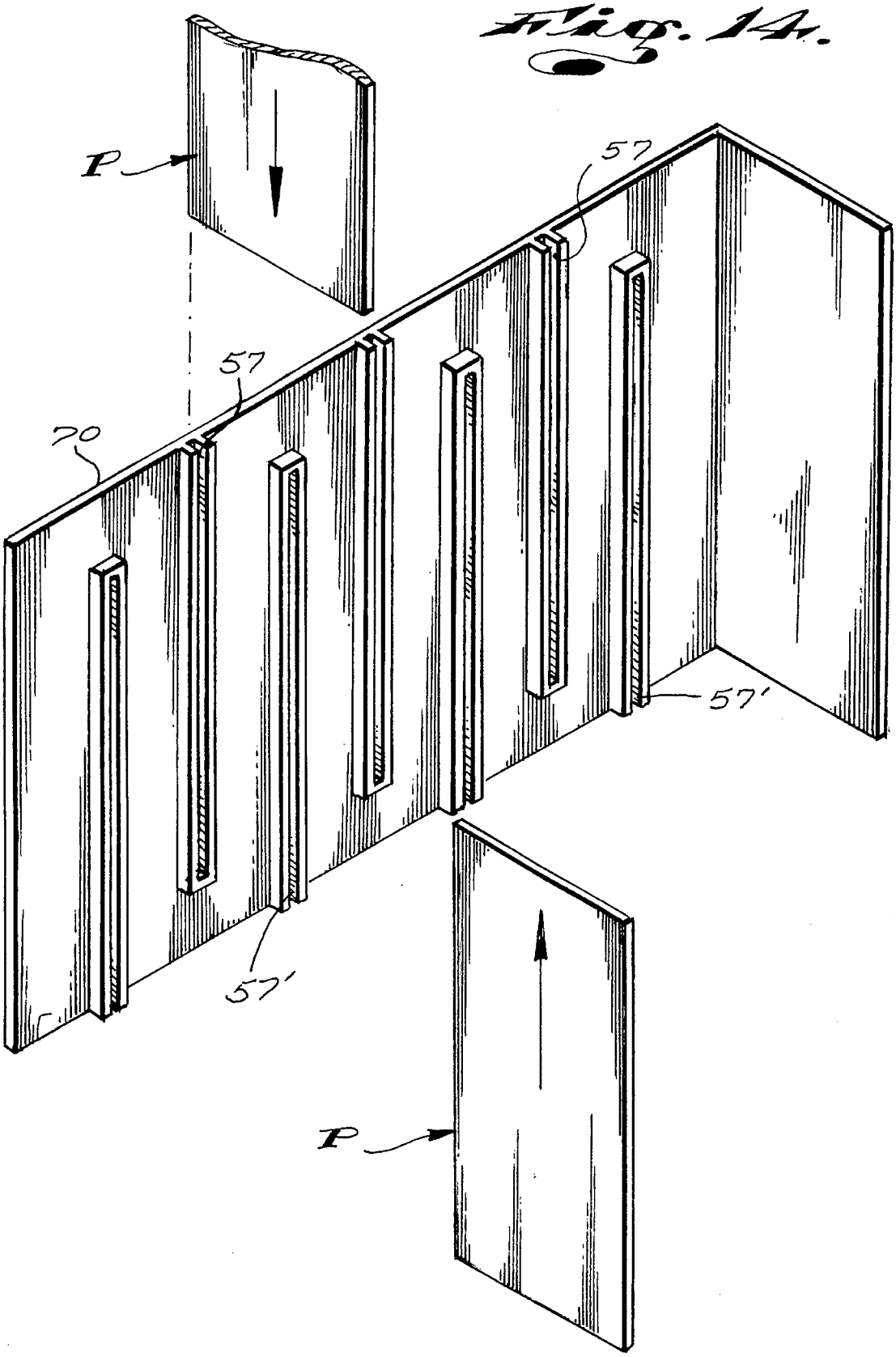
FIG. 14 is an enlarged isometric view of a panel structure embodied in the form of the invention shown in FIG. 13.

The details of construction of the tank T can be varied without departing from the broader aspects and spirit of our invention. For the purpose of this disclosure, one preferred tank structure is illustrated in FIGS. 10, 11 and 12 of the drawings. In FIGS. 13 and 14 of the drawings, we have shown a second preferred tank structure.

Referring to FIGS. 1 0, 11 and 12 of the drawings, the tank T has spaced apart, flat, vertical front and rear walls 50 and 51, laterally spaced flat, vertical, end walls 52 and 53 and flat, vertically spaced, horizontal top and bottom walls 54 and 55. The front and rear walls 50 and 51 are formed with a plurality of laterally spaced vertically extending channel-like portions 56 that define inwardly opening grooves 57. The grooves 57 in the front wall 50 are aligned with and oppose related grooves 57 in the rear wall 51.

Within the tank T is a plurality of flat, elongate, rectangular partitions T of thin flat sheet metal. Each partition P is arranged to extend between the front and rear walls 50 and 51 with its vertical side edge portions securely engaged in related grooves 57. The partitions P are shorter in vertical extent than the vertical distance between the top and bottom walls 54 and 55 a distance that is substantially the same as the distance between adjacent partitions. Every other or second partition is positioned up in the tank with its top edge engaged with the top wall 54 and with its bottom edge spaced above the bottom wall 55; and, the intermediate partitions P are positioned down in the tank with their upper edges spaced below the top wall 54 and their bottom edges engaging the bottom wall 55. The partitions thus arranged within the tank T define the elongate serpentine or zig-zag flow passage F.

In the embodiment of the invention now under consideration, the opposite upstream and downstream ends 20 and 21 of the flow passage terminate at the opposite ends of and are closed by the bottom wall of the tank. The end 21 of the flow passage, shown at the left side of the tank T, is the downstream end of the flow passage, and the end of the flow passage at the right side of the tank is the upstream end 20 of the flow passage.

It is to be noted that the spaced metal partitions P establish single boundaries between adjacent vertical reaches or legs of the flow passage F and are pressure-insensitive (unaffected by fluid pressure). The foregoing is unlike and is to be distinguished from parallel adjacent fluid-conducting tube sections or the like where two adjacent walls separate a column of fluid moving therethrough.

In the preferred carrying out of the invention, the width of the partitions P is greater than the lateral distance between adjacent partitions P so that the greater part of the surface area of the tank structure defining the flow passage F is defined by the surfaces of the partitions. The total surface area of the portions of the walls of the tank that define the top, bottom and outside surfaces of the flow passage is notably less than the surface area of the partitions that define the passage. Accordingly, the greater portion of heat that is likely to be conducted out of or from within each leg portion of the flow passage is conducted through the partitions that form that leg of the flow passage into adjacent leg portions of the flow passage.

The front wall 50 and the side wall 53 of the tank T is made of a single sheet of metal, and the rear wall 51 and end wall 52 are made of another single sheet of metal. The edges of the front and rear walls, that are not integrally joined with an end wall, are formed with flanges 60 that abut and are fixed to opposing edge portions of their related end walls.

The top and bottom walls 54 and 55 are flat horizontal sheet metal parts with vertical flanges 61 about their perimeters that slidably enter their related upper and lower ends of the assembled front, rear and end walls, as shown.

The ends of the partitions P that engaged their related top and bottom walls 54 and 55 are formed with mounting flanges 61 (see FIG. 12 of the drawings) that engage and are fixed to their related top and/or bottom walls.

The coolant coil C and water supply tube 23, with its water prechiller tube 23', are arranged with and fixed to the bottom wall of the tank and are related to the partitions P fixed to that wall before it is assembled with the front, rear and end walls of the tank.

When the bottom wall with its related parts fixed to it is engaged in the bottom of the tank structure, the top wall, with its related partitions, is slidably engaged into the tank structure.

During assembly of the tank structure, adjacent portions of all of the sheet metal parts are spot welded together and the tubular parts engaged through walls of the tank are welded in place. After the tank is fully assembled, all of the exterior joints and seams of the structure are filled and sealed by welding. Thereafter, the assembly is subjected to a process, not unlike silver soldering, that works to fill all seams, cracks, crevices and interstices with metal and to further fix the parts together and to completely seal the tank structure.

The resulting tank structure is extremely strong and durable and has proven to be such that when filled with water and that water is frozen, the structural integrity of the tank will not be compromised. In tests conducted, the tank structure has been repeatedly filled with water and the water therein has been in excess of ten times without structural failure. During repeated freeze testing of the tank, portions thereof have stretched and become distorted, but the structural integrity of the tank has not been compromised.

In FIGS. 13 and 14 of the drawings, we have shown another embodiment of our invention wherein the partition receiving grooves 57' at the front and rear walls 50' and 51' are defined by two like insert panels 70 established of a suitable plastic material. The grooves 57' terminate in the panels to establish stops that engage ends of the partitions P' to hold them in proper vertical position within the tank T'. In this noted second embodiment of our invention, the front and rear walls of the tank need not be formed to establish grooves and the partitions P' need not be formed with mounting flanges for mounting the partitions in place within the tank by welding. Provision and use of the noted panels make this structure notably easier and less costly to make than the structure shown in FIGS. 10 through 12 of the drawings. Further, the plastic insert panels, being established of a plastic having a low coefficient of heat conductivity establish thermal-insulating barriers between the large and expansion front, rear and end walls of the tank and the water or other liquid flowing through the flow passage within the tank. Accordingly, the amount of heat that is likely to be conducted through the front, rear and end walls of the tank is notably reduced.

In practice, the coolant delivery and return tubes or lines 20' and 21' and water inlet tube 23 are engaged with and fixed to the bottom wall at the same time that the coil C and tube 23 are engaged with and fixed thereto.

Prior to engaging the top wall 54 with its related parts of the tank structure, the water conducting line 25 is engaged through and welded in fixed position in openings in the top wall of the tank.

During assembly of the tank, switch-receiving parts for the switches 30 and 31 are engaged through and fixed with their related wall or walls of the tank.

The water-dispensing line 26 can be related to the line 25 during or subsequent to assembly of the tank.

In practice, the several lines and/or fittings extending through walls of the tank can be repositioned in any suitable position in and about the tank structure without departing from the broader aspects and spirit of our invention.

In the preferred carrying out of our invention, the case 40 of the insulating jacket structure is fabricated of stainless steel and is made to accommodate as much of the parts of heat exchange structure that project from or occur outside of the tank as is practical and is such that when filled with the noted thermal insulating foam 41, maximum thermal insulation of the tank and its related parts is attained.

Having described only typical preferred forms and applications of our invention, we do not wish to be limited to the specific details herein set forth but wish to reserve to ourselves any modifications and/or variations that might appear to those skilled in the art and that fall within the scope of the following claims.

Having described our invention, we claim:

1. A heat exchanger comprising a pressure sealed tank defining an elongate flow passage with upstream and downstream ends, an elongate coolant-conducting tube with upstream and downstream end extending longitudinally of and substantially centrally within the flow passage, coolant supply means conducting coolant to the tube for circulation therethrough, liquid inlet means including an inlet line connected with a pressurized liquid supply and connected with and conducting liquid into the flow passage, a check value in the liquid inlet lines, chilled liquid outlet means including a liquid dispensing line, means connecting the dispensing line with the flow passage, a normally closed dispensing valve in the dispensing line, chilled liquid recirculating means including electric powered pump connected directly with and between the upstream and downstream end portions of the flow passage and continuously recirculating the chilled liquid in the tank through the flow passage and about the tube.

2. The heat exchanger set forth in claim 1 wherein the coolant conducting tube has upstream and downstream end portion exiting the tank at the downstream and upstream ends of the flow passage and connected with the coolant supply means.

3. The heat exchanger set forth in claim 1 wherein the chilled liquid outlet means includes an elongate liquid conducting line connected with and extending between the upstream and downstream end portions of the flow passage and with which the dispensing line is connected said coolant supply means includes an electric-powered means that operates to selectively start and stop the supply of coolant to the tube, a normally closed temperature-responsive switch is connected in a power supply to the electric powered means and is responsive to the temperature of liquid in the tank.

4. The heat exchanger set forth in claim 1 wherein the chilled liquid outlet means is at the top of the tank, the liquid inlet means includes a check valve checking the back flow of liquid from the tank therethrough, said coolant supply means includes an electric-powered means that operates to selectively start and stop the supply of coolant to the tube, a normally closed pressure-responsive switch is connected in a power supply to the electric powered means and is responsive to the pressure on the liquid in the tank.

5. The heat exchanger set forth in claim 1 the chilled liquid outlet means is at the tope of the tank, said coolant supply means includes an electric-powered means that operates to selectively start and stop the supply of coolant to the tube, a normally closed pressure-responsive switch is connected in the electric powered means and is responsive to the pressure on the liquid in the tank, a normally closed temperature-responsive switch is connected in a per supply to the electric powered means and is responsive to the temperature of liquid in the tank.

6. The heat exchanger set forth in claim 1 wherein the tank has substantially flat, vertical, laterally spaced side alls, substantially flat, spaced front and rear walls, vertically spaced top and bottom walls and a plurality of flat vertical partitions in lateral spaced parallel relationship with and between the end walls and extending between the front and rear walls and defining the elongate flow passage of zig-zag form within the tank, the tube is an elongate coolant-conducting coil of zig-zag form, the coolant conducting coil has upstream and downstream end portions exiting the tank at the downstream and upstream end portion of the flow passage and connected with the coolant recirculating means, the liquid inlet means includes an elongate pre-chiller line connected with the inlet line and extending longitudinally through a portion of the flow passage.

7. The heat exchanger set forth in claim 1 wherein the tank has substantially flat, vertical, laterally spaced side walls, substantially flat, spaced front and rear walls, vertically spaced top and bottom walls and a plurality of flat vertical partitions in lateral spaced parallel relationship with and between the end walls and extending between the front and rear walls defining the elongate flow passage in zig-zag form within the tank, the tube is an elongate coolant-conducting coil of zig-zag form, the coolant conducting coil has upstream and downstream end portions exiting the tank and connected with the coolant supply means, the chilled liquid outlet means at the tope of the tank, the liquid inlet means includes a [check valve to stop back flow of water from the tank therethrough, said coolant supply means includes an electric-powered means that operates to selectively start and stop the supply of coolant to the tube, a normally closed temperature-responsive switch is engaged in a power supply to the electric-powered memos and is responsive to the temperature of liquid in the tank.

8. The heat exchanger set forth in claim 1 wherein the tank has substantially flat, vertical, laterally spaced side walls, substantially flat, spaced front and rear walls, vertically spaced top and bottom walls and a plurality of flat vertical partitions in lateral spaced parallel relationship with and between the end walls and extending between the front and rear walls defining the elongate flow passage in zig-zag form within the tank, the tube is an elongate coolant-conducting coil of zig-zag form, the coolant-conducting coil has end portions exiting the tank and connected with the coolant supply means, the chilled liquid outlet means is at the top of the tank, the liquid inlet means includes said coolant recirculating means includes an electric-powered means that operates to selectively start and stop the supply of coolant to the coil, a normally closed pressure-responsive switch is engaged in a power supply to the electric-powered means and is responsive to the pressure of liquid in the tank.

9. The heat exchanger set forth in claim 1 wherein the tank has substantially flat, vertical, laterally spaced side walls, substantially flat, spaced front and rear walls, vertically spaced top and bottom walls and a plurality of flat vertical partitions in lateral spaced parallel relationship with and between the end walls and extending between the front and rear walls defining the elongate flow passage in zig-zag form within the tank, the tube in an elongate coolant-conducting coil of zig-zag form, the coolant-conducting coil has end portions exiting the tank and connected with the coolant supply means, the chilled liquid outlet means is at the top of the tank, inlet means includes a check valve to stop back flow of water from the tank therethrough,] said coolant supply means includes an electric-powered means that operates to selectively start and stop the supply of coolant to the coil, a normally closed pressure-responsive switch is engaged in a power supply to the electric-powered means and is responsive to the pressure on the liquid in the tank, a normally closed temperature-responsive switch is connected in the power supply to the electric powered means and is responsive to the temperature of liquid in the tank.

10. The heat exchangers et forth in claim 1 wherein the tank has substantially flat, vertical, laterally spaced side walls, substantially flat, spaced front and rear walls, vertically spaced top and bottom walls and a plurality of flat vertical partitions in lateral spaced parallel relationship with and between the end walls and extending between the front and rear walls and defining the elongate flow passage in zig-zag form within the tank, the tube is an elongate coolant-conducting coil of zig-zag form, the flow passage has two vertically extending straight leg portions defined by the end walls and adjacent partitions and related portions of the tope, bottom, front and rear walls and has a plurality of laterally spaced intermediate vertical straight leg portions defined by adjacent partitions and related portions of the top, bottom, front and rear walls, the partitions are less in vertical extend than the vertical distance between the top and bottom walls, adjacent partitions are vertically offset relative to each other so that one projects vertically upwardly from the bottom wall and is spaced from the top wall and the other depends vertically downward from the top wall and is spaced above the bottom wall, the surface area of the surfaces of the partitions defining each intermediate vertical leg portion of the flow passage is greater than the combined surface are of those portions of the tope, bottom, front and rear walls that define each leg portion of the flow passage.

11. The heat exchanger set forth in claim 1 wherein the tank has substantially flat, vertical laterally spaced side walls, substantially flat, spaced front and rear walls, vertically spaced top and bottom walls and a plurality of flat vertical partitions in lateral spaced parallel relationship with and between the end walls and extending between the front and rear walls and defining the elongate flow passage in zig-zag form within the tank, the tube is an elongate coolant-conducting coil of zig-zag form, the flow passage has two vertically extending straight leg portions defined by the end walls and there adjacent partitions are related portions of the tope, bottom, front and rear walls and has a plurality of laterally spaced intermediate vertical straight leg portions defined by adjacent partitions and related portions of the top, bottom, front and rear walls, the partitions are less in vertical extend than the vertical distance between the top and bottom walls, adjacent partitions are vertically offset relative to each other so that one projects vertically upwardly from the bottom wall and is spaced from the top wall and the other depends vertically downward from the top wall and is spaced above the bottom wall, the walls of the tank are established of sheet metal, the front and rear walls are formed with opposing pairs of rearwardly and forwardly opening vertically extending partition-engaging grooves, the partitions are sheet metal parts with vertical edge portions engaged in related pairs of grooves and each has a mounting flange at one end that is fixed to its related top or bottom wall.

12. The heat exchanger set forth in claim 1 wherein the tank has substantially flat, vertical, laterally spaced side walls, substantially flat, spaced front and rear walls, vertically spaced top and bottom walls and a plurality of flat vertical partitions in lateral spaced parallel relationship with and between the end walls and extending between the front and rear walls and defining the elongate flow passage in zig-zag form within the tank, the tube is an elongate coolant-conducting coil of zig-zag form, the flow passage has two vertically extending straight leg portions defined by the end walls and adjacent partitions and related portions of the top, bottom, front and rear walls and has a plurality of laterally spaced intermediate vertical straight leg portions defined by adjacent partitions and related portions of the top, bottom, front and rear walls, the partitions are less in vertical extend than the vertical distance between the top and bottom walls, adjacent partitions are vertically offset relative to each other so that one projects vertically upwardly from the bottom wall and is spaced from the top wall and the other depends vertically downward from the top wall and is spaced above the bottom wall, the walls are established of sheet metal, panels of plastic material having a low index of heat conductivity overlie the opposing rearwardly and forwardly disposed surfaces of the front and rear walls and are formed with forwardly and rearwardly opening opposing pairs of vertical of groves, the partitions are sheet metal parts with vertical edge portions engaged in related pairs of grooves in the panels.

13. The heat exchanger set forth in claim 1 wherein the tank has substantially flat, vertical, laterally spaced side walls, substantially flat, spaced front and rear walls, vertically spaced top and bottom walls and a plurality of flat vertical partitions in lateral spaced parallel relationship with and between the end walls and extending between the front and rear walls and defining the elongate flow passage in zig-zag form within the tank, the tube is an elongate coolant-conducting coil of zig-zag form, the flow passage has two vertically extending straight leg portions defined by the end walls and adjacent partitions and related portions of the top, bottom, front and rear walls, the partitions are less in vertical extend than the vertical distance between the top and bottom walls, adjacent partitions are vertically offset relative to each other so that one projects vertically upwardly from the bottom wall and is spaced from the top wall and the other depends vertically downward from the top wall and is spaced above the bottom wall, the walls are established of sheet metal, panels of plastic material having a low index of heat conductivity overlie the opposing rearwardly and forwardly disposed surfaces of the front and rear walls and have opposing pairs of rearwardly and forwardly opening vertical grooves, the partitions are sheet metal parts with vertical edge portions engaged in related pairs of grooves in the panels, the grooves in the panels correspond in vertical extent and position with the vertical extend and position of the partitions engaged therein.

14. The heat exchanger set forth in claim 1 wherein the tank has substantially flat, vertical, laterally spaced side walls, substantially flat, spaced front and rear walls, vertically spaced top and bottom walls and a plurality of flat vertical partitions in lateral spaced parallel relationship with and between the end walls and extending between the front and rear walls and defining the elongate flow passage in zig-zag form within the tank, the tube is an elongate coolant-conducting coil of zig-zag form, the flow passage has two vertically extending straight leg portions defined by the end walls and adjacent partitions and related portions of the top, bottom, front and rear walls and has a plurality of laterally spaced intermediate vertical straight leg portions defined by adjacent partitions and related portions of the top, bottom, front and rear walls, the partitions are less in vertical extend than the vertical distance between the top and bottom walls, adjacent partitions are vertically offset relative to each other so that one projects vertically upwardly from the bottom wall and is spaced from the top wall and the other depends vertically downward from the top wall and is spaced above the bottom wall, the walls are established of sheet metal, panels of plastic material having a low index of heat conductivity overlie the opposing rearwardly and forwardly disposed surfaces of the front and rear walls and have opposing pairs of forwardly and rearwardly opening grooves, the partitions are sheet metal parts with vertical edge portions engaged in related paris of grooves in the panels, the grooves in the panels correspond in vertical extent and position with the vertical extend and position of the partitions engaged therein, the surface area of the surfaces of the partitions defining each vertical leg portion of the flow passage is greater than the combined surface areas of the portions of the walls of the tank that define each leg portion of the flow passage.

15. The heat exchanger set forth in claim 1 wherein the coolant supply means is a refrigeration machine including an electric power compressor and the tube is a refrigerant expansion tube for the machine.

16. The heat exchanger set forth in claim 1 wherein the coolant supply means is an electric powered glycol chilling machine with an electric-powered glycol recirculating pump with which the ends of the tube are connected, a normally closed pressure actuated switch responsive to the pressure within the tank is engaged in a power supply to the glycol recirculating pump.

* * * * *